United States Patent [19]

Crossman et al.

[11] Patent Number: 5,035,515

[45] Date of Patent: Jul. 30, 1991

[54] PACKAGING HAVING DETACHABLE COUPON COMPARTMENT

[76] Inventors: Stephen A. Crossman, 16594 Terrasse Richelieu, Apt. 10, Ste-Geneviève, Canada, H9H 3P4; John R. Lloyd, 1294 Belair Drive, Dorval, Canada, H9S 1H7

[21] Appl. No.: 480,297

[22] Filed: Feb. 15, 1990

[51] Int. Cl.[5] ..... B65D 30/22

[52] U.S. Cl. ..... 383/38; 383/40; 229/70; 206/831

[58] Field of Search ..... 383/38, 39, 40, 106, 383/120, 121; 229/70; 206/831

[56] References Cited

U.S. PATENT DOCUMENTS

| | | | |
|---|---|---|---|
| 1,881,890 | 10/1932 | Offenbacher | 383/40 |
| 2,226,943 | 12/1940 | Poppe | 229/70 |
| 2,867,372 | 1/1959 | Fox | 383/40 X |
| 3,291,374 | 12/1966 | Lepisto et al. | 383/40 X |
| 3,762,628 | 10/1973 | Sargent | 229/56 |
| 3,804,323 | 4/1974 | Bemel | 383/40 |
| 3,813,028 | 5/1974 | Greason | 229/70 |
| 4,010,964 | 3/1977 | Schechter | 283/56 |
| 4,097,067 | 6/1978 | Schechter | 283/56 |
| 4,520,958 | 6/1985 | Jones et al. | 229/72 |

FOREIGN PATENT DOCUMENTS

| | | | |
|---|---|---|---|
| 510382 | 8/1931 | Fed. Rep. of Germany | 383/40 |
| 292212 | 3/1936 | Italy | 383/40 |

OTHER PUBLICATIONS

"Bag-A-Diser" by Utility Plastic Bag Company as Published in Modern Packaging in Aug. 1953.

*Primary Examiner*—Stephen Marcus
*Assistant Examiner*—Jes F. Pascua
*Attorney, Agent, or Firm*—Nixon & Vanderhye

[57] ABSTRACT

There is disclosed a packaging comprising a pocket made of sheet material, the pocket defining an enclosure for holding merchandise and having at least one sealed edge. One or more detachable compartments are formed by extensions of the sheet material beyond the at least one sealed edge. A seal along at least one edge of the extensions closes the compartment. A promotional message is carried by the detachable compartment, and a perforation line extends parallel to the at least one sealed edge of the pocket on each compartment side thereof to make the compartment detachable from the pocket by a consumer. The extensions are folded back towards the sealed edge to form at least one sheet of the sheet material enclosed by the compartment. The pocket remains functional when the compartment is detached.

14 Claims, 4 Drawing Sheets

PACKAGING HAVING DETACHABLE COUPON COMPARTMENT

BACKGROUND OF THE INVENTION

The present invention relates to a packaging having a detachable coupon compartment. When the coupon compartment is detached, the packaging is still functional.

Consumer discount or promotion coupons are conventionally delivered in the retail environment by including a loosely printed coupon inside the packaging or by printing the promotional message directly onto the packaging.

The drawbacks associated with the conventional methods are many. Loosely inserted coupons require separate production and insertion into the packaging, which can become expensive. Loose coupons may also be lost or overlooked. Coupons printed directly onto packaging are not as easily lost or overlooked, however they are not easily removed and if they are removed, the packaging is damaged.

Printed discount or promotional coupons for the improvement of retail sales of promotional activities require inexpensive distribution vehicles because of the vast quantities required in order to produce a reasonable calculated rate of response. The end user can only be reached in volume with these coupons through the use of inexpensive mass distribution media. When considering the advantages of one particular media over another there are many points that are taken into consideration. The cost per thousand (C.P.M.) ratio is the underlying factor along with specific market group and saturation or exposure. The ideal media should deliver the advertising or promotional message to the most suitable target audience at the lowest cost per thousand impressions. Even small incremental improvements in the costs and control of the distribution results in impressive overall costs savings. Because of the enormous volume of coupons distributed annually to potential consumers in this country, which basically is a consumer-oriented society.

A medium used quite often for distributing advertising or promotional coupons in the prior art is co-op mailing insertions. Several coupons from several manufacturers or retail outlets are grouped together and inserted in a single envelope for distribution to the consumer. Each insert is charged a fixed price according to the quantities delivered. This prior art method of distributing coupons has proven to be quite practical and successful, however with the over abundance of co-op mailings being delivered to each consumer, many consider this approach as intrusive and annoying. In addition the coupon receives no special attention since in fact it is one of many inserted in the same envelope. Promotions, offers and rebates as well as specific products often compete against each other. Co-op mailings are generally drop shipped to lobbies of buildings and apartments. Actual circulation and participation figures are quite unreliable. In addition, co-op mail inserts are subject to constantly increasing cost pressures since mailing rates for this type of distribution are generally increasing and are expected to further escalate in the future.

Another form of prior art coupon distribution media is the printing of coupons directly on the pages of a magazine or newspaper. This requires the consumer to use scissors to cut out the coupon for redemption and also necessitates mutilation of the page and loss by the consumer of whatever may be printed on the backside of the coupon. In many instances the consumer may be reluctant to cut out the coupon, especially in the case of magazines which the consumer may wish to retain, e.g., when an article of interest is at least partially printed on the backside of the coupon.

Another prior art media used by several merchandisers is to include coupons in or on flexible packages, particularly packages of foods, candy, etc. The insertion of the coupon during the foodpackaging operation has led to difficulties in the material handling, besides possibly soiling the coupons, defacing or otherwise rendering it less attractive in marketing. Coupons printed directly on flexible packaging require the consumer to use scissors to cut out the coupon and necessitates mutilation of the packaging. Thus the lifespan of the product freshness or packaging presentation may be shortened.

Another prior art form of promotional "Instant Win" coupons consists of "Scratch & Win" cards. These coupons or contest cards are generally printed offset or web press. They utilize an opaque latex overprint which is either printed or screen printed over the prize special or rebate rendering the message undectable. The consumer removes this mask by rubbing or scratching the latex removing it from the coupon or card and exposing the message printed below. This prior art of producing an instant win promotion has proven to be quite practical and successful. However, the costs of manufacturing and distributing the cards are quite high since costs are constantly increasing and are expected to escalate in the future. Coupons of this sort are distributed by all the aforementioned prior art methods including distribution at the retail level. An underlying problem associated with distributing any coupon at the retail level is human error. Physical insertion of any coupon is both time consuming for management and general personnel. Constant change of personnel and shifts can lead to a breakdown in the distribution cycle. Others are bought and paid for but never reach the consumer due to forgetfullness or too much activity at the checkout counter. Others must be printed with special non toxic inks and then must be cello wrapped for package insertion at even greater expense. In recent years counterfeiting of coupons has been quite common with the advent of colour copiers and more sophisticated prepress and printing equipment.

SUMMARY OF THE INVENTION

The object of the invention is to provide a packaging for retail merchandise or the like, designed to incorporate an advertising message together with consumer discount or promotional coupons which, when removed, do not destroy the packaging itself.

According to the invention, this object is achieved by a packaging comprising:

a pocket made of sheet material, the pocket defining an enclosure for holding merchandise and having at least one sealed edge;

at least one detachable compartment formed by extensions of the sheet material beyond the at least one sealed edge;

a seal along at least one edge of the extensions to close the compartment;

a promotional message carried by the detachable compartment; and a perforation line extending parallel to the at least one sealed edge of the pocket on each compartment side thereof to make the compartment detachable from the pocket by a consumer, the pocket remaining functional when the compartment is detached.

The invention offers many benefits. When coupons or other promotional messages are carried by the detachable compartment (i.e., printed on it, printed inside it, adhered to it or adhered in it) it is ensured that the customer will receive the message or coupon. The detachable compartment may be of any practical size allowing for the message or coupon to be of any size as needed. The addition of the detachable compartment to a packaging vehicle can result in a very small cost increase, especially when the detachable compartment forms an integral part of the packaging. Production cost, e.g., printing, is absorbed by the existing packaging itself. This small increase in packaging cost over the existing packaging cost translates into a very small C.P.M. (cost per thousand). In many cases there is no marginal increase over the standard packaging cost, e.g., a manufacturer of candies, food or the like who presently uses flexible packaging can incorporate the detachable coupon compartment without having to increase significally packaging costs. In the case of plastic retail shopping bags, retailers and the like can now incorporate promotional or advertising coupons directly on the bag. The advantages to this are many. The increase in manufacturing costs with the detachable coupon compartment is very small, since all production costs are incorporated into the standard bag. This translates into a very small C.P.M. When the consumers detach the coupon compartment from the bag, the bag remains intact and thus can still be used many times over. Retailers who now absorb the total cost of the bags can offset this cost by selling complete or partial advertising space on the detachable coupon compartment. Thus lowering their overall costs substantially while retaining the benefits from the additional advertising exposure. Whenever the advertising or promotional coupon incorporates an instant win prize or special rebate offer, the advantages are further increased. Instant winners are printed directly on the bag, hidden inside the detachable compartment, thus eliminating the need for latex overprinting. The customer simply detaches the coupon compartment and looks inside the compartment to see the message or prize. Messages carried by the inside of the compartment can be used for indicating hidden contest winners and instant surprise rebates, and such prizes would not be detectable from the exterior of the bag.

When the packaging is made of plastic, the plastic coupon is much more difficult to copy than a conventional paper coupon. Color photocopies can work with paper but currently not with plastic. It has been found that counterfeit of coupons is becoming a serious problem.

BRIEF DESCRIPTION OF THE DRAWINGS

The invention will be better understood by means of the following non-limiting description of a preferred embodiment of the invention with reference to the drawings in which.

DETAILED DESCRIPTION OF THE PREFERRED EMBODIMENT

Figure 1:
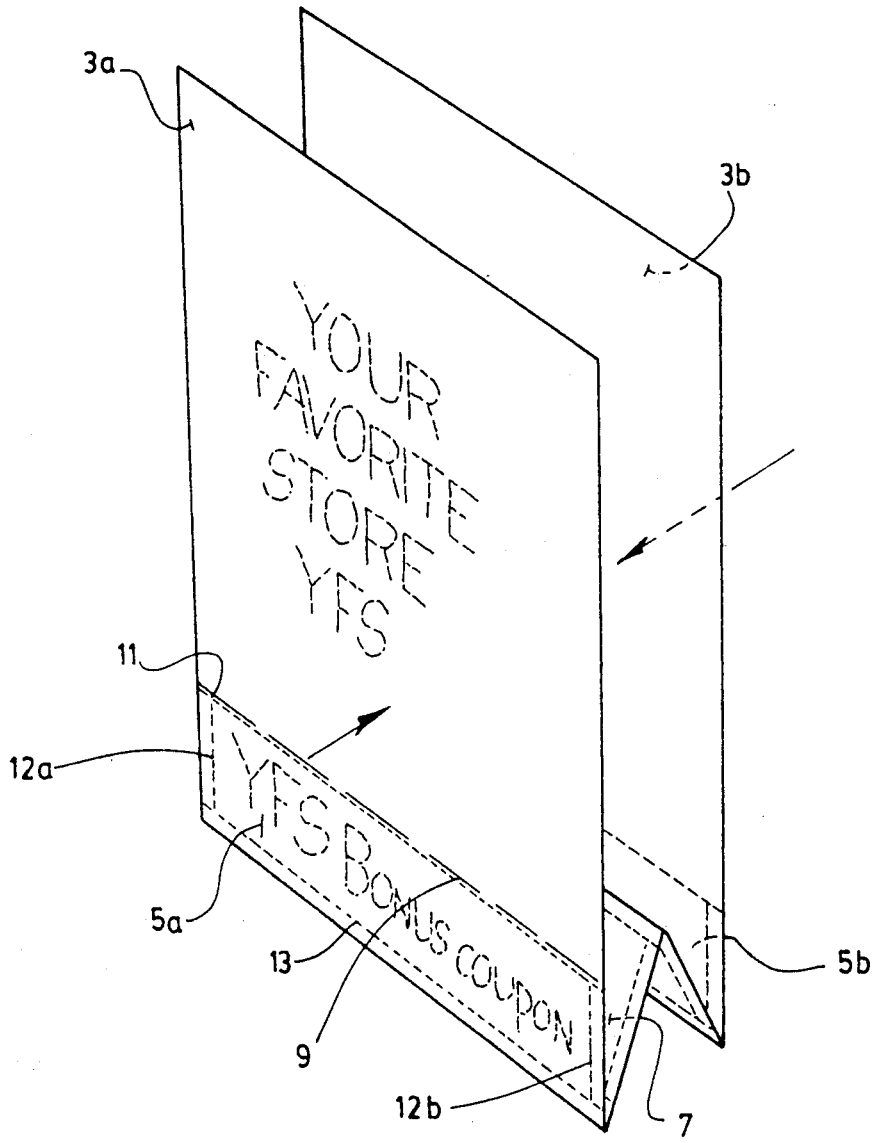
FIG. 1 is a side expanded perspective view of a plastic bag according to a preferred embodiment of the invention.
Figure 2:
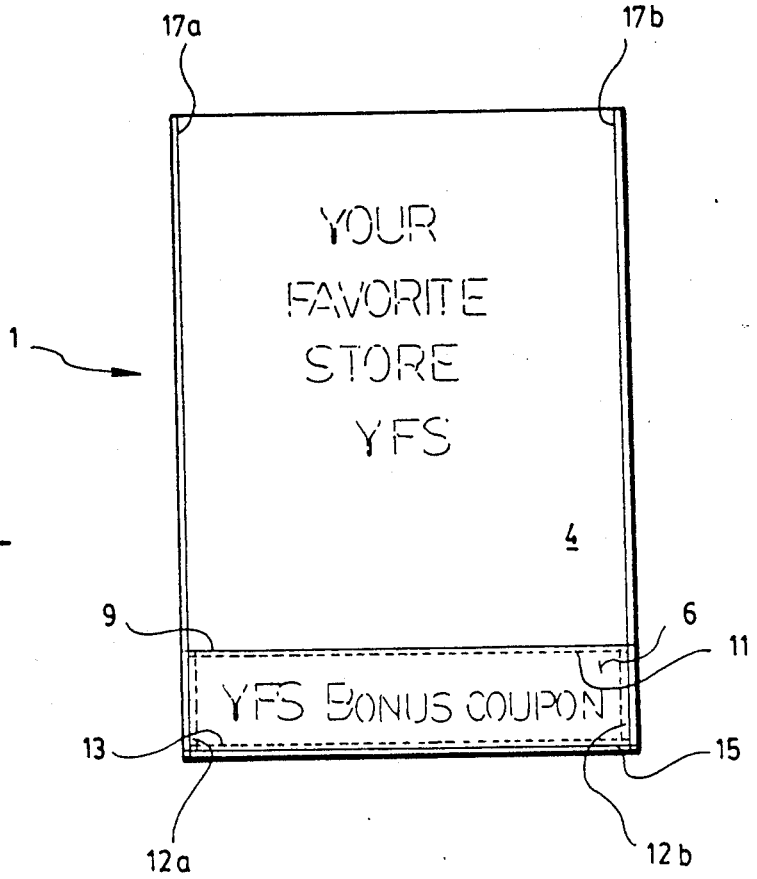
FIG. 2 is a front view of the preferred embodiment of FIG. 1.

FIGS. 1 and 2 show a packaging according to the invention, in the form of a retail shopping bag 1 having an open merchandise pocket 4 and a coupon compartment 6. In the preferred embodiment, the packaging comprises bag 1 made from a continuous polyethelene plastic web using machinery well known in the art to fold, cut, thermoseal and perforate the bag as required.

Pocket 4 is formed by sides 3*a* and 3*b* made from plastic sheet material sealed by seals 17*a* and 17*b*. Seal 9 closes the bottom of the pocket 4 and divides sides 3 from extensions 5. Extensions 5*a* and 5*b* form compartment 6 and are integral with sides 3*a* and 3*b* respectively. Seal 15 closes the bottom of compartment 6. Compartment 6 is thus made with bag 1 and no extra manufacturing step is added.

Figure 5:
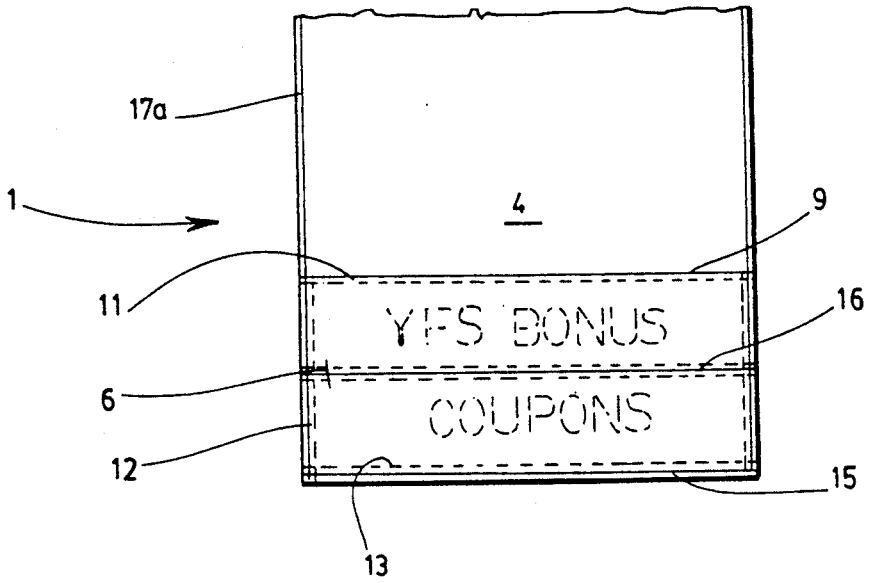
FIG. 5 is a front view of the detachable compartment having two sets of coupons.

Compartment 6 is detachable from pocket 4 by perforation line 11. Coupons 8*a*, 8*b*, 8*c*, 8*d* are contained within compartment 6 and may be detached therefrom by perforation lines 11, 12*a*, 12*b* and 13. In the embodiment shown, four separate coupons 8 are formed. Of course, if gusset 7 has its apex below seal 9 and perforation 11, then coupons 8*b* and 8*c* would become joined together rather than separated. In so doing, a much larger coupon 8*b*, 8*c* is made and provides a larger advertising surface. In the embodiment shown in FIG. 5, compartment 6 is divided into subcompartments. It can be preferable to provide compartment 6 with further perforation lines 16 and possibly also seal lines not shown to divide compartment 6 such that each coupon 8 is dividable into two or more coupons. An example of this is to make each coupon 8 of double height, and to put a perforation line 16 in tho middle, as shown in FIG. 5.

Figure 3:
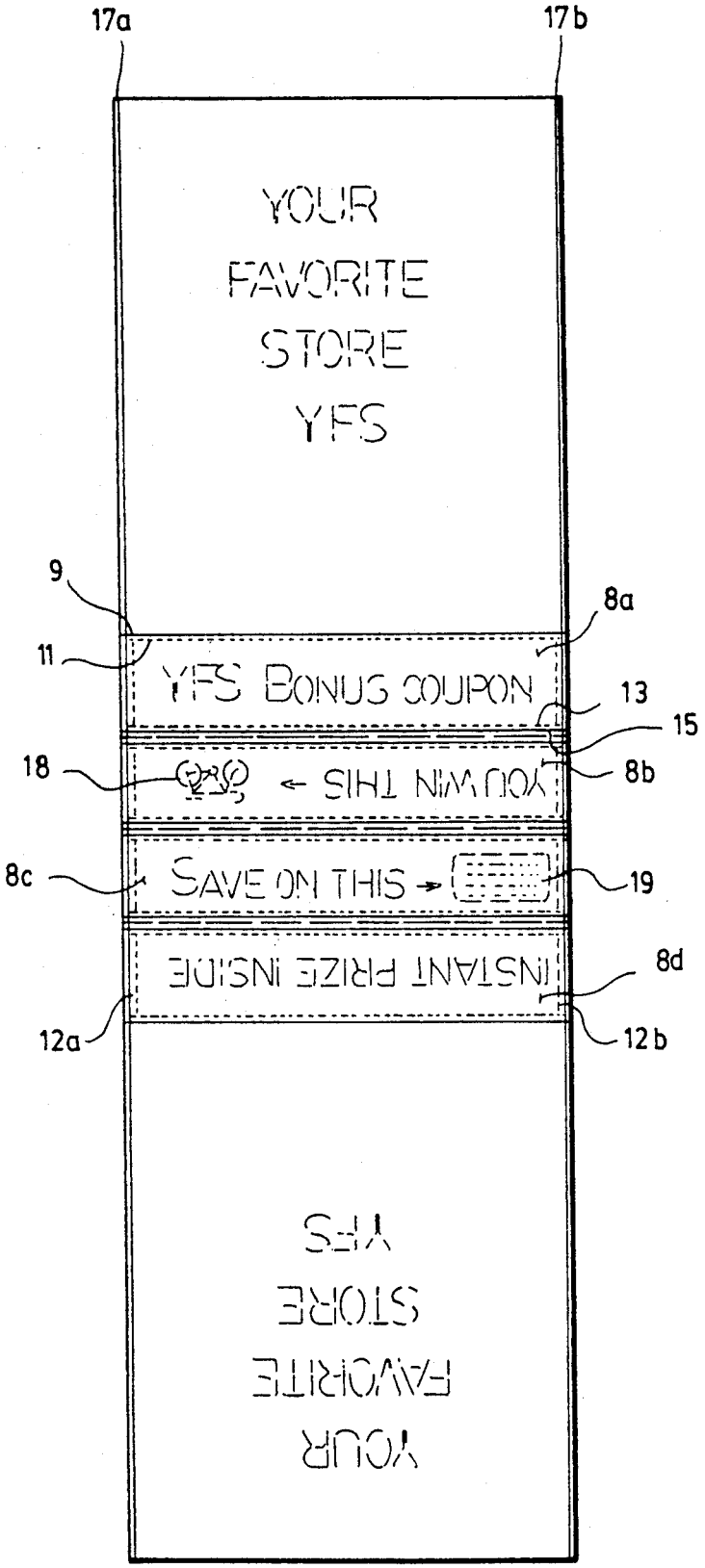
FIG. 3 is a plan view of the front and back opened up of the preferred embodiment of FIGS. 1 and 2.

As shown in FIG. 3, coupon 8*b* is provided with an ink stamp 18 indicating a prize to be won. The stamp 18 may indicate a contest winner or the amount of a special prize rebate. Similarly, sticker 19 indicates a prize or rebate to be given to the consumer when the detachable compartment 6 is detached and opened. The sticker 19 can also be a standard paper coupon which is stuck to one of the compartment coupons 8 by a suitable adhesive. Stamp 18 and sticker 19 may be applied to either side of coupons 8, and they can be applied to the preprinted sheet material of the packaging 1 either as a final stage of the printing process or during the manufacture of the packaging. In the preferred embodiment, the sheet material is made of plastic, and therefore compartment 6 and coupons 8 are more resistant to tampering than if a paper construction is used. Of course, it is not necessary to provide coupons 8 with a sticker 19 or stamp 18, since coupons 8 may carry regular promotional coupons or advertizing messages.

Figure 4:
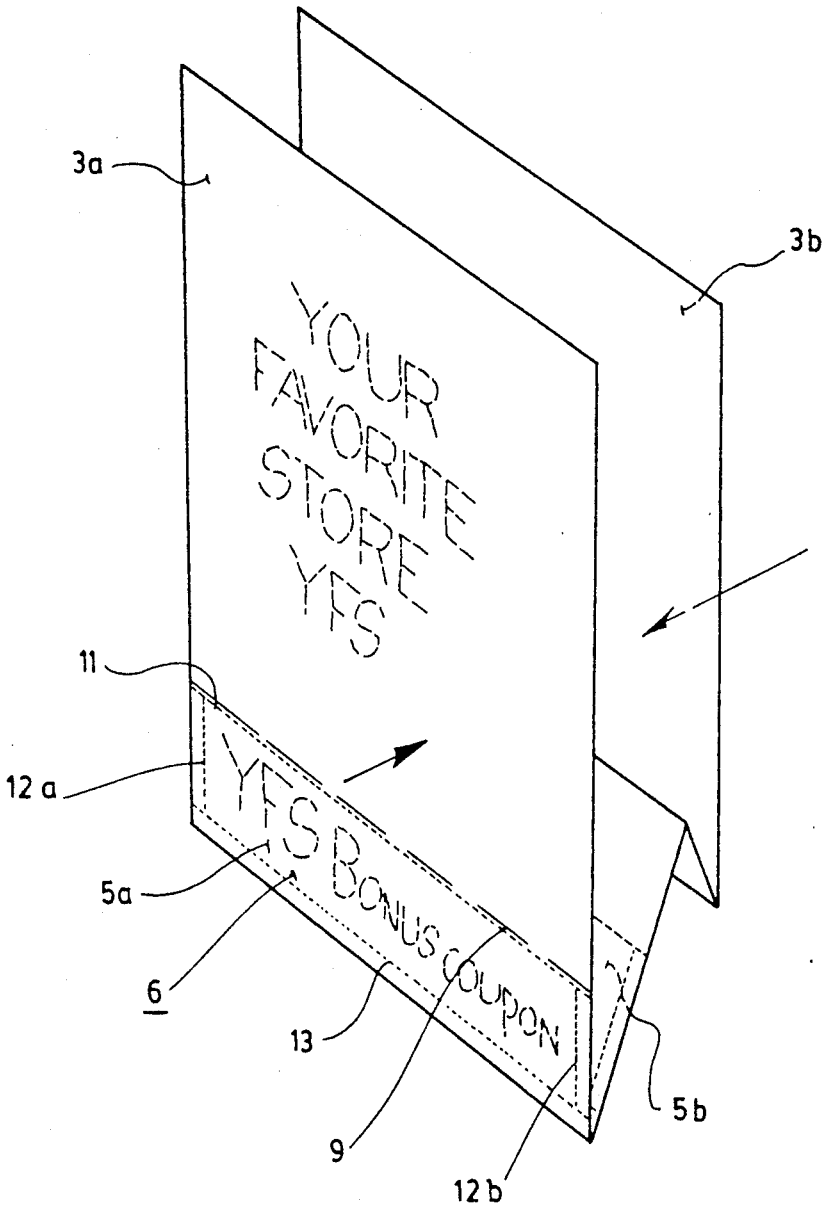
FIG. 4 is side view similar to FIG. 1 of another preferred embodiment.

If pocket 4 is to have a gusset at its bottom or on its sides, it is still possible to provide the detachable coupon compartment 6 as an extension from the bottom of a gusset 14, as shown in FIG. 4. As in FIG. 1, the compartment 6 in FIG. 4 is formed by integral extensions 5*a* and 5*b* beyond seal 9. Perforation line 11 makes compartment 6 detachable and perforation lines 13 and 12 make the coupons separable. The presence of the compartment 6 does not interfere with the function of the gusset 14 in allowing pocket 4 to hold more merchandise. Although compartment 6 is shown as a simple V-shaped extension from seal 9, it is of course possible to have a W-shaped gusset extension from seal 9, as shown in FIG. 1.

Of course, more than one compartment 6 can extend from pocket 4. In the embodiment of FIG. 4, another compartment 6 could extend from the opposite bottom of the gusset 14, to provide two detachable coupon compartments. In the preferred embodiment, the detachable compartment 6 is provided at the bottom of pocket 4. Additionally or alternatively, a compartment 6 can be placed extending from the sides or top of pocket 4.

Although in the preferred embodiment, the packaging 1 is shown to consist of a plastic shopping bag which uses pocket 4 to carry merchandise, pocket 4 may be closed at the top and may be used to package commercial goods, such as potato chips or candy. Furthermore, the packaging may be made of any suitable sheet material such as plastic, paper or foil. The perforation lines 11, 12 or 13 may be any mechanically weakened lines to facilitate separation.

When the packaging according to the invention is to be suspended from a rack, as in the case of small display racks or "peg board" style store displays, the packaging can be provided with a hole or holes at the top to receive support hooks or prongs. In this case, it is preferable to place the compartment 6 at the top of the packaging and to have the hole or holes provided through the extensions 8, so that the hole or holes do not interfere with the pocket 4.

The seals 17, 9 and 15 may be provided using an adhesive, heat bonding, thermosealing, ultra-sound sealing or any suitable sealing means. All of the seals 15, 17 shown in the preferred embodiment may not be required, since the sheet material can be continuous and thus the seal is replaced merely by a fold in the material. For example, a bag having no gusset 14 and only a V-shaped compartment 6 could be made from a continuous flattened tube of sheet material, thus making seals 17*a* and 17*b* unnecessary.

It is to be understood that the above description of the invention is not intented to limit the scope of the present invention as defined in the appended claims.

We claim:

1. A packaging comprising:

a pocket made of sheet material, said pocket defining an enclosure for holding merchandise and having at least one sealed edge;

at least one detachable compartment having at least one enclosed sheet of said material, the compartment being formed by extensions of said sheet material beyond said at least one sealed edge, said extensions being folded back towards said at least one sealed edge to form said at least one enclosed sheet of said material;

a seal along at least one edge of said extensions to close said compartment;

a promotional message printed on said extensions of said detachable compartment; and a perforation line extending parallel to said at least one sealed edge of said pocket on a compartment said thereof to make said compartment detachable from said pocket by a consumer, said pocket remaining functional when said compartment is detached.

2. The packaging as defined in claim 1, wherein said compartment is further provided with at least one other perforation line to divide said compartment into at least two parts, and wherein said message is at least partly divide among said at least two parts, so that a separate message may be carried by each said part.

3. The packaging as defined in claim 2, wherein a seal line is provided adjacent said at least one other perforation line to thereby close two said parts from one another.

4. The packaging as defined in claim 1, wherein on said sheet material inside said compartment, a stamp indicative of a prize or rebate to be awarded to said consumer is provided.

5. The packaging as defined in claim 1, wherein on said sheet material inside said compartment, a sticker indicative of a prize or rebate to be awarded to said consumer is provided.

6. The packaging as defined in claim 1, wherein said extensions form a gusset.

7. The packaging as defined in claim 6, wherein an apex of said gusset is sealed with said sealed edge.

8. The packaging as defined in claim 7, wherein said compartment is further provided with at least one other perforation line to divide said compartment into at least two parts, and wherein said message is at least partly divided among said at least two parts, so that a separate message may be carried by each said part.

9. The packaging as defined in claim 8, wherein a seal line is provided adjacent said at least one other perforation line to thereby close two said parts from one another.

10. The packaging as defined in claim 6, wherein said compartment is further provided with at least one other perforation line to divide said compartment into at least two parts, and wherein said message is at least partly divided among said at least two parts, so that a separate message may be carried by each said part.

11. The packaging as defined in claim 10, wherein a seal line is provided adjacent said at least one other perforation line to thereby close two said parts from one another.

12. The packaging as defined in claim 1, wherein said pocket comprises a gusset, and said at least one detachable compartment is formed by said extensions beyond at least one sealed edge of said gusset.

13. The packaging as defined in claim 1, wherein said sheet material is made of polyethelene plastic.

14. The packaging as defined in claim 1, wherein said extensions are integral with said sheet material.

* * * * *